US005814162A

United States Patent [19]

Barrett et al.

[11] Patent Number: 5,814,162

[45] Date of Patent: Sep. 29, 1998

[54] AIR AND SPRAY NOZZLE

[75] Inventors: John M. Barrett, Williamsville; Thomas P. Moore, Buffalo, both of N.Y.

[73] Assignee: Collom International, Inc., Buffalo, N.Y.

[21] Appl. No.: 719,471

[22] Filed: Sep. 25, 1996

[51] Int. Cl.[6] ..... B08B 9/04

[52] U.S. Cl. ..... 134/22.12; 134/167 C; 134/169 C; 118/317

[58] Field of Search ..... 134/22.13, 22.12, 134/167 C, 166.2, 166 C, 168 C, 169 C; 15/302, 315, 104.061, 109.31; 239/293, 251, 738; 118/317, 323

[56] References Cited

U.S. PATENT DOCUMENTS

| | | | |
|---|---|---|---|
| 1,587,194 | 6/1926 | Sladden . | |
| 3,106,491 | 10/1963 | Leibner | 118/317 |
| 3,120,346 | 2/1964 | Willhoite | 239/293 |
| 3,215,560 | 11/1965 | Kredit . | |
| 3,359,943 | 12/1967 | Briggs et al. | 118/323 |
| 3,410,250 | 11/1968 | Kulie et al. | 118/317 |
| 3,814,322 | 6/1974 | Waldrum | 239/251 |
| 4,099,674 | 7/1978 | Standley | 134/171 |
| 4,110,092 | 8/1978 | Kunioka et al. | 134/167 C |
| 4,380,477 | 4/1983 | Saunders . | |
| 4,500,492 | 2/1985 | Yamakawa . | |
| 4,718,142 | 1/1988 | Wahlers | 15/315 |
| 4,841,999 | 6/1989 | Danko . | |
| 4,995,201 | 2/1991 | Von Borcke et al. | 134/167 C |
| 5,003,998 | 4/1991 | Collett . | |
| 5,143,105 | 9/1992 | Katayama . | |
| 5,213,120 | 5/1993 | Dickson | 134/168 C |
| 5,296,037 | 3/1994 | Faxon . | |
| 5,383,975 | 1/1995 | Faxon . | |
| 5,423,917 | 6/1995 | Garcia, Jr. | 134/22.12 |

FOREIGN PATENT DOCUMENTS

| | | | |
|---|---|---|---|
| 2076383 | 3/1991 | Canada . | |
| 805209 | 5/1951 | Germany . | |
| 3039028 | 5/1982 | Germany | 134/167 R |
| 4013547 | 10/1991 | Germany | 134/167 C |
| 299567 | 4/1992 | Germany | 134/167 C |
| 41358 | 5/1925 | Norway . | |
| 925443 | 5/1982 | U.S.S.R. | 134/167 R |
| 1062311 | 12/1983 | U.S.S.R. | 134/22.12 |
| 905397 | 2/1992 | U.S.S.R. | 134/167 C |

*Primary Examiner*—Frankie L. Stinson
*Attorney, Agent, or Firm*—Jaeckle Fleischmann & Mugel, LLP

[57] ABSTRACT

A nozzle system comprising a nozzle connected to a first supply conduit having an enclosed second supply conduit. The first supply conduit at the proximal end is connected to a first source of medium while the second supply conduit at the proximal end is connected to a second source of medium. The first supply conduit at the distal end is connected to nozzle openings that discharges first medium which propels said nozzle system through a pipe line and removes debris from said pipe line. The second supply conduit at the distal end is connected to a nozzle sprayer that discharges a second medium directed forward from the first supply conduit.

15 Claims, 3 Drawing Sheets

AIR AND SPRAY NOZZLE

FIELD OF THE INVENTION

This invention relates generally to nozzles and the method used.

BACKGROUND OF THE INVENTION

Many methods and products have been developed to cleanse pipe lines, especially ventilation pipes and ventilation ducts of large cross-sectional areas, in buildings. Such nozzles are disclosed in U.S. Pat. Nos. 5,296,038 and 5,383,975 (hereinafter referred collectively as Faxon). Faxon discloses a cleaning nozzle which is connected via a supply conduit with a source of pressure medium, and which exhibits a nozzle opening in the form a largely continuous annular gap which extends along the periphery of the nozzle. The largely continuous gap is connected to the supply conduit and the source of pressure medium. The pressure medium is made to discharge through the annular gap in order to in part clean inner walls of pipe lines, and also, as a result of the forces of reaction from discharging medium, to make the nozzle move into the pipeline. These results are best attained when the pressure medium is compressed air. The nozzle is brought into contact with an inner wall of the pipe line in that a reduced pressure is established between the nozzle and the inner wall and it is made to move around about the cross-section of the pipe line by twisting of the supply conduit.

In the past, the Faxon nozzle system used a second medium. The second medium was usually a mist or a liquid to sanitize the pipe line. In some instances the second medium was combined with the first medium, usually compressed air. In other instances; the second medium was used alone in the nozzle system. The results were impractical. For example, we used a liquid agent alone in the Faxon system. When using just a liquid in the Faxon system, the liquid discharges from the annular gap uncontrollably and excessively. Such a discharge causes leakage in the pipe line system.

In another example, we used a mist agent in the Faxon system. The mist when combined with the preferred first medium, compressed air, does not work well. The mist coagulates in the annular gap of the nozzle system. Moreover, it is extremely difficult to ascertain the quantity of the mist applied to the inner wall of the pipe line.

A problem to solve is to have a nozzle capable of performing the objectives to in part clean inner walls of pipe lines, to also as a result of the forces of reaction from discharging medium make the nozzle move into the pipe line, and to provide a second discharging medium upon the inner walls of the pipe line.

Another problem to solve is to have a nozzle capable of performing the objectives to in part clean inner walls of pipe lines, to also as a result of the forces of reaction from discharging medium make the nozzle move into the pipe line, and to provide a second medium that does not coagulate within the nozzle system.

A problem to solve is to have a nozzle capable of performing the objectives to in part clean inner walls of pipe lines, to also as a result of the forces of reaction from discharging medium make the nozzle move into the pipe line, and to provide desired quantity of a second medium upon the inner walls of the pipe line.

SUMMARY OF THE INVENTION

Our invention provides a solution for these problems. Our invention is a process and product to clean pipe lines. Our invention entails a nozzle system comprising a nozzle connected to a first supply conduit having an enclosed second supply conduit. The first supply conduit at the proximal end is connected to a first source of medium while the second supply conduit at the proximal end is connected to a second source of medium. The first supply conduit at the distal end is connected to nozzle openings that discharges first medium which propels the nozzle system through a pipe line and removes debris from the pipe line. The second supply conduit at the distal end is connected to a nozzle sprayer that discharges a second medium that is directed forward from the first supply conduit.

An object of the present invention is to have a nozzle capable of performing the objectives to in part clean inner walls of pipe lines, to also as a result of the forces of reaction from discharging medium make the nozzle move into the pipe line, and to provide a second discharging medium upon the inner walls of the pipe line.

Another object of the present invention is to have a nozzle capable of performing the objectives to in part clean inner walls of pipe lines, to also as a result of the forces of reaction from discharging medium make the nozzle move into the pipe line, and to provide a second pressure medium that does not coagulate within the nozzle system.

An object of the invention is to have a nozzle capable of performing the objectives to in part clean inner walls of pipe lines, to also as a result of the forces of reaction from discharging medium make the nozzle move into the pipe line, and to provide desired quantity of a second pressure medium upon the inner walls of a pipe line.

These and other objects and advantages of the present invention can be determined from the following description of preferred embodiments according to the invention and the accompanying drawings and claims.

DETAILED DESCRIPTION OF THE PREFERRED EMBODIMENTS

Figure 1:
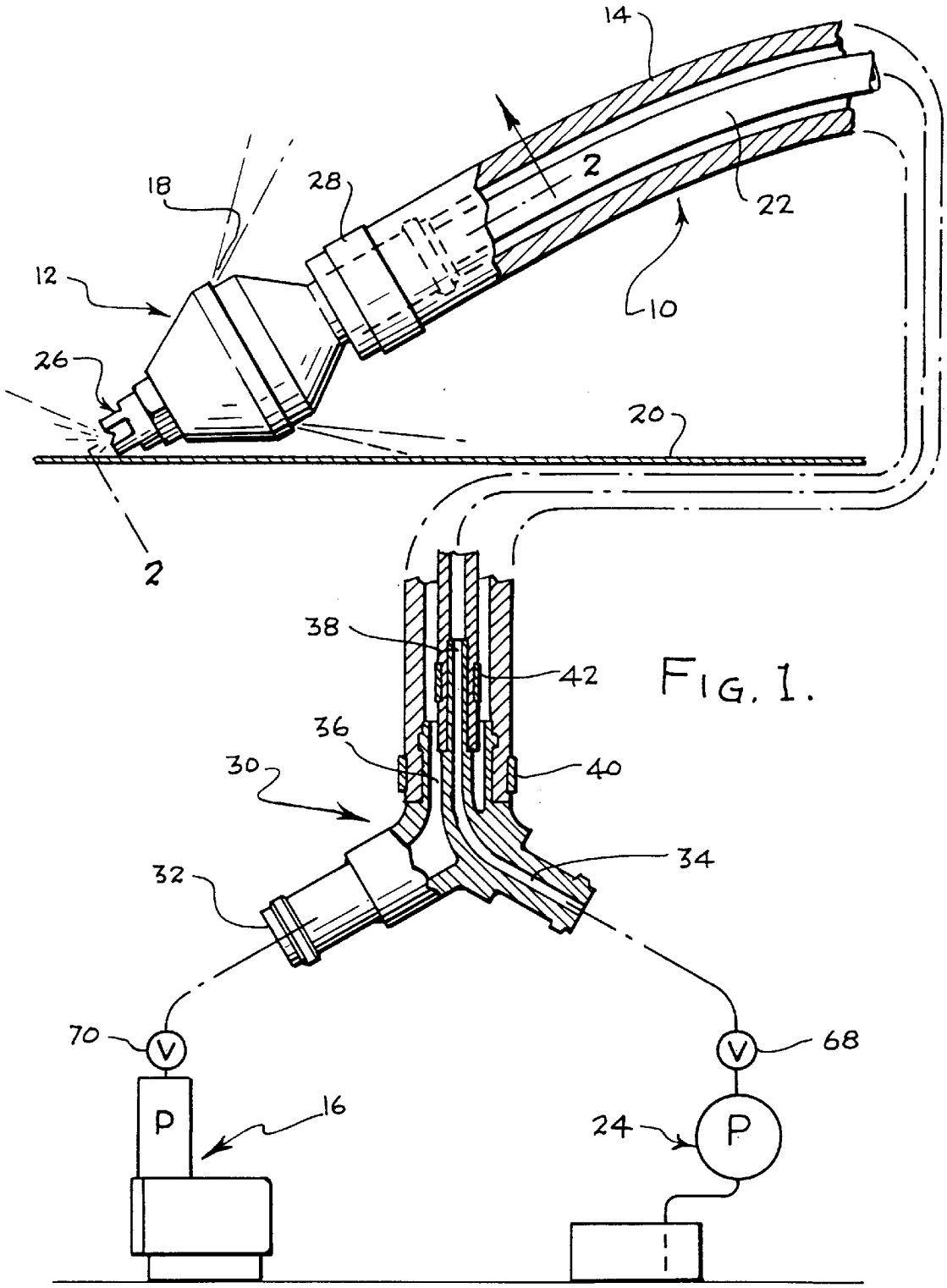
FIG. 1 is an example of a nozzle system.

A nozzle system 10 is illustrated in FIG. 1 comprising a nozzle 12 which is fixedly arranged at the distal end of a first supply conduit 14 for feeding a first medium supplied by a compressor 16 to nozzle opening 18 of the nozzle 12. The first medium discharges through the nozzle opening 18 in order to propel the nozzle system 10 through a pipe line 20 and remove debris from the inner walls of the pipe line. Within the first supply conduit 14 is a second supply conduit 22 for feeding a second medium supplied by a pump 24 to a sprayer 26 of the nozzle 12. After the debris in the pipe line is removed, the second medium discharges through the sprayer 26 a sufficient and controlled quantity upon the inner walls of the pipe line 20. To ensure the first supply conduit 14 is not loosened from the nozzle system 10 during the cleaning process, the first supply conduit 14 is fastened on the nozzle 12 by a clamp 28. At the proximal end of the nozzle system 10, there is a double Y fitting 30. The Y fitting 30 has two receiving openings 32, 34 located at the branches of the Y fitting that are interconnected with two respective discharging openings 36, 38 located at the base of the Y fitting. The first supply conduit 14 is secured upon the discharging opening 36 by clamp 40. The second supply conduit 22 is secured upon the discharging opening 38 by a clamp 42. The pump 24 is connected to the receiving opening 34 while the compressor 16 is connected to the receiving opening 36. Thereby, the first supply conduit 14 encloses the second supply conduit 22 from the base of the fitting 30 to nozzle 12.

Figure 2:
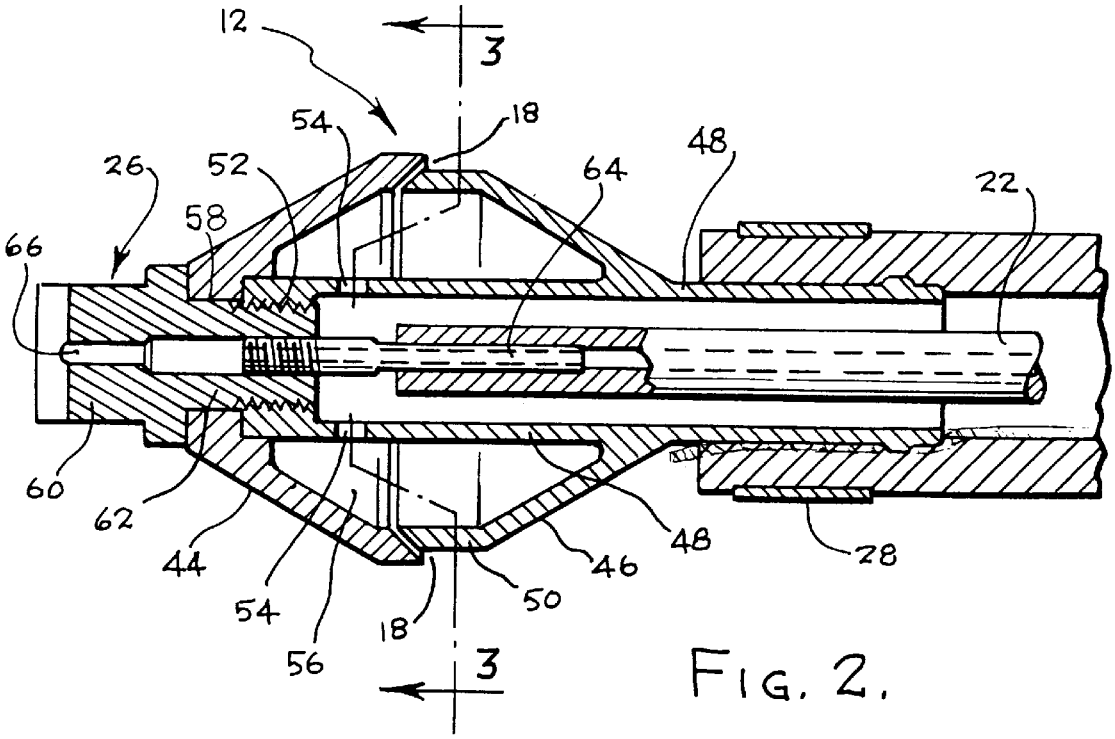
FIG. 2 is a longitudinal cross sectional view of FIG. 1 along line 2—2.
Figure 3:
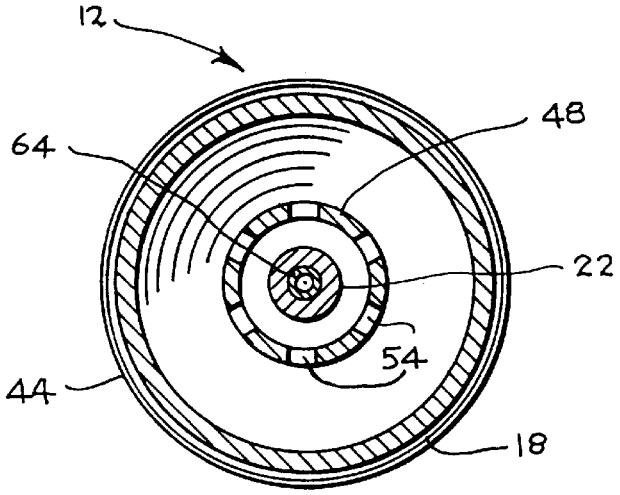
FIG. 3 is a cross sectional view of FIG. 2 along line 3—3

The nozzle 12, as illustrated in FIG. 2, has a sprayer 26, a front piece 44 and a rear piece 46. The rear piece 46 is provided with a coupling pipe 48 and a flange 50. At the proximal end of the coupling pipe 48 the first supply conduit 14 is secured to the nozzle 12 by clamp 28. At the distal end, the coupling pipe 48 has a threaded securing means 52 which receives, secures and positions the sprayer 26 to receive the second supply conduit 22. The coupling pipe 48 also exhibits distribution holes 54, as illustrated in FIG. 3, which are arranged symmetrically about its central axis. The holes 54 discharge the first medium into a receiving chamber 56 located between the coupling pipe 48 and the flange 50. The receiving chamber 56 is formed when the front piece 44 is properly placed upon the flange 50 of the rear piece 46. The first medium discharges from the receiving chamber 54 through the nozzle opening 18 formed from the annular gap between the support 50 and the front piece 44.

The front piece 44 has a receiving cavity 58 and a design that forces the discharge of the first medium toward the first supply conduit 14. The receiving cavity 58 is arranged about the central axis of the nozzle 12. The cavity 58 receives the sprayer 26 that connects with the rear piece 34.

The sprayer 26 has a top portion 60, a middle portion 62, a bottom portion 64 and an aperture 66. An example of a sprayer 26 is a Spraying Systems Co. Model H1/8W 5003. The sprayer 26 can discharge the second medium it receives from the pump 24 at about 0.33 gallons per minute.

The pump 24 is a conventional pump that has hoses and pumping mechanisms. An example of the pump 24 is a Wagner Pro Gold Professional Series 1,25 LAM (Model 833CW15). To control the pump output, we have found that a conventional valve is quite useful. This pump supplies up to 0.33 gallons (1.25 Liters) per minute of the second medium through the second supply conduit 22. The second medium is preferably a conventional sanitizing or coating fluid agent (which includes gases and liquids). We have found that the following fluid agents work exceptionally well in this invention: Tough Coat™ by Vac System Industries of Apple Valley, MN; Oxine® (AD) and EnviroCon™ by Bio-Cide International, Inc. of Norman, Okla. Air Duct Encapsulant-ADE by Mateson Chemical Corporation of Philadelphia, Pa. Portersept® by Courtaulds Coating Co. of Louisville, Ky. Foster Duct Liner Adhesive Coating, Foster Fungicidal Protective Coating, and Foster Duct Liner Insulation Sealer by Foster Products Corporation of Vadnais Heights, Minn. BBJ Air Conditioning Microbiocide™ by BBJ Chemical Compounds, Inc. of Ruskin, Fla. and Ozone from Air Products of Allentown, Pa. To control the output of the second medium, the pump 24 has a valve 68.

Meanwhile, the first medium that passes through the first supply conduit 14 is usually a conventional gas, like air. Compressed air is one of the most efficient and economical means to in part clean inner walls of pipe lines, and as a result of the forces of reaction from discharging medium to make the nozzle move into the pipe line. One way to accomplish these means is to connect a conventional compressor 16, like an Atlas Compco (Model XAS-90), to the fitting 30. The compressor contains a valve 70 that controls the output of the first medium.

To ensure the nozzle moves down the pipe line 20, the nozzle can be bent at an acute angle, like 10 to 40 degrees, relative to the central axis of the first supply medium. Preferably, the angle of the nozzle is 15 degrees.

In other embodiments of the present invention, it is preferred that first and second supply conduits 14, 22 have certain requirements. The first requirement is the conduit is any type of flexible material able to withstand about 400 psi. The second requirement is the conduit is capable of being moved down the pipe line 20 by the discharging the first medium through the nozzle openings 18.

Figure 6:
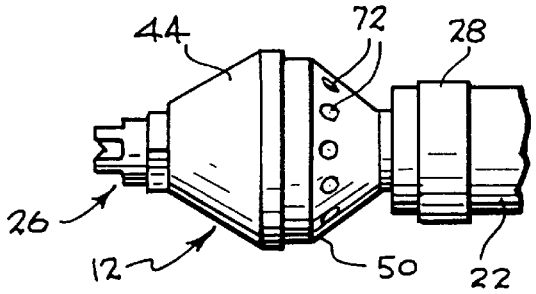
FIG. 6 is an alternative embodiment of the opening nozzle of a nozzle.

The nozzle opening 18 can be an annular gap as shown in FIG. 1 or holes 72, located on the flange 50 as shown in FIG. 6. If the holes 72 are used, the front piece 44 is locked onto the flange 50 to create the receiving chamber 56 but there is no annular gap between the front piece 44 and the flange 50. The only requirements for the nozzle opening 18 are that the nozzle opening 18 discharges the first medium so the nozzle is driven into pipe line 20 and to clean the inner walls of the pipe line 20. Preferably, the angle of the nozzle opening 18 in relation to the central axis of the nozzle 12 is 15 to 45 degrees, more preferably 30 degrees.

Figure 4:
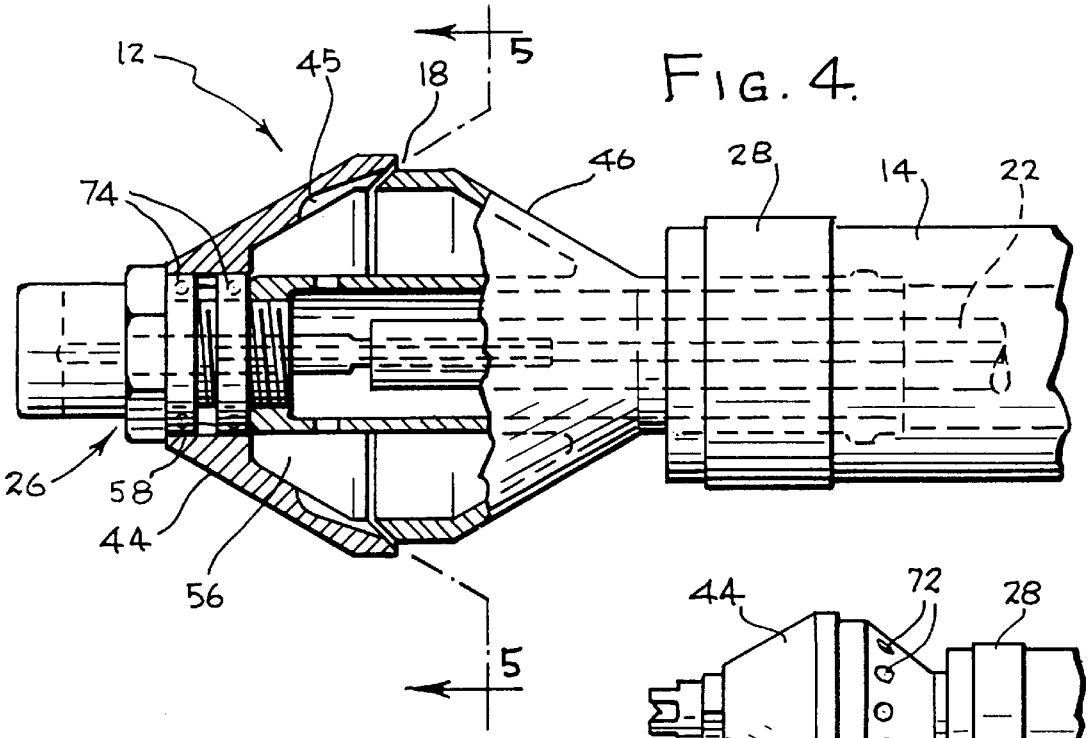
FIG. 4 is a longitudinal cross sectional view of an alternative embodiment of the nozzle similar to FIG. 2 with parts in elevation.
Figure 5:
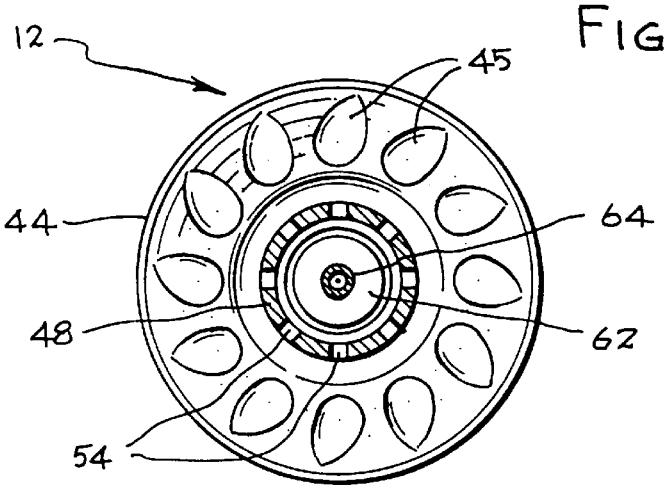
FIG. 5 is a cross sectional view of FIG. 4 across line 5—5.

In yet another embodiment of the present invention as illustrated in FIG. 4, the front piece 44 has ball bearings 74 located at the receiving cavity 58 to allow the nozzle to rotate. To ascertain the nozzle 12 will rotate in the desired direction, the nozzle 12 has angular milled cavities 45 in the receiving chamber 56 to direct the first medium in the desired direction as illustrated in FIG. 5. Thereby, the nozzle will rotate about and move down a circular pipe line 20.

The cleaning operation consists in that nozzle 12 after the insertion in the ventilation pipe line 20 which is to be cleaned, is fed with compressed air in the first supply conduit 14. At high speed compressed air consequently discharges back out from the nozzle opening 18 along the periphery of the nozzle 12, so that the nozzle 12 is driven into the pipe line 20 as a result of the forces of reaction from the discharging air, and carries the first supply conduit 14 along with the enclosed second supply conduit 22 with it. The nozzle 12 bears against the inner wall of the pipe line 20 and is maneuvered in a lateral direction in that the first supply conduit 14 is twisted to the one side or the other. Simultaneously debris is released from the inner walls of the pipe line 20 as a result of the cutting effect which is produced by the air discharging from the nozzle opening 18, and the irregular movements of the nozzle 12 and impacts against the inner walls of the pipe line 20.

As a result of the reduced pressure which is formed at the inner wall directly against the nozzle opening 18, the nozzle 12 is pressed firmly against the inner walls of the pipe line 20 and can be maneuvered forwardly and reversely to each and all inner surfaces in the pipe line 20 independently of the cross-sectional form of the duct, that is to say both along largely vertical and horizontal side surfaces in the pipe line 20 and surfaces which form ceilings of the pipe line 20.

After the pipe line 20 is cleaned of its debris, the nozzle is repeatedly moved into the pipe line 20 by the compressed air. This time, the sprayer 26 is used to apply a fluid agent within the pipe line 20. To ensure proper application of the fluid agent, it is recommended that the compressed air be maintained. The compressed air released from the nozzle opening 18 blows backward which in turn causes a Baleen effect that ensures the fluid agent is applied to all the spaces of the pipe line.

Although our invention is described by reference to specific preferred embodiments, it is clear that variations can be made or other material used without departing from the spirit of the invention as claimed.

What we claim is:

1. A nozzle system comprising a first supply conduit having an enclosed second supply conduit;

a first source of medium connected to first supply conduit;

a second source of medium connected to second supply conduit;

a nozzle connected to said first and second supply conduits;

a nozzle opening of said nozzle discharges said first medium which propels said nozzle system through a pipe line and removes debris from said pipe line; and a sprayer of said nozzle discharges said second medium which is directed forward from the first supply conduit.

2. A nozzle system according to claim 1 in which said first medium is a gas.

3. A nozzle system according to claim 2 in which said first medium is compressed air.

4. A nozzle system according to claim 1 in which said second medium is a fluid agent.

5. A nozzle system according to claim 4 in which said fluid agent is a sanitizing agent.

6. A nozzle system according to claim 4 in which said fluid agent is a gaseous cleaning agent.

7. A nozzle system according to claim 4 in which said fluid agent is a coating agent.

8. A nozzle system according to claim 1 in which said first source of medium is a compressor.

9. A nozzle system according to claim 1 in which said second source of medium is a pump.

10. A nozzle system according to claim 1 in which said nozzle is angled at an acute angle relative to the central axis of the first supply conduit.

11. A nozzle system according to claim 1 in which said nozzle opening is an annular gap.

12. A nozzle opening according to claim 11 in which said nozzle rotates.

13. A nozzle system according to claim 1 in which said nozzle opening is holes.

14. A process to cleanse a pipe line with a nozzle system connected via a first supply conduit to a first source of medium, and wherein the cleaning means has at least one nozzle opening which is directed backwards towards the first supply conduit at an acute angle relative to a center line which extends through a fastening of the first supply conduit to the nozzle system, and the first medium being made to discharge through the nozzle opening and in part clean inner walls of a pipe line and force the nozzle system to move into the pipe line by the force resulting from the discharge of the first medium from the nozzle opening, said process including the steps of bringing the nozzle system into contact with the inner wall of a pipe line, a reduced pressure is established on opposite sides of the nozzle opening, and the nozzle system is made to move around about the cross-section of the pipe line; and said process is repeated along with the discharging of a second medium from a nozzle sprayer of said nozzle discharging a second medium which is directed forward from the first supply conduit, said second medium is supplied to said nozzle by a second supply conduit enclosed within said first supply conduit and connected to a second source of medium.

15. A process according to claim 14 further including the step of controlling the speed of movement of the nozzle system into the pipe line.

* * * * *